United States Patent [19]

Anderson

[11] Patent Number: 4,687,041

[45] Date of Patent: Aug. 18, 1987

[54] GUIDED CORD SYSTEM FOR A RETRACTABLE SLATTED BLIND ASSEMBLY

[75] Inventor: Richard N. Anderson, Owensboro, Ky.

[73] Assignee: Hunter Douglas Inc., Totowa, N.J.

[21] Appl. No.: 562,540

[22] Filed: Dec. 19, 1983

[51] Int. Cl.[4] ..... E06B 9/30

[52] U.S. Cl. ..... 160/168 R; 160/84 R

[58] Field of Search ..... 160/168 R, 168 B, 173, 160/178 R, 166, 84 R, 172

[56] References Cited

U.S. PATENT DOCUMENTS

| | | | |
|---|---|---|---|
| D. 276,966 | 1/1985 | Georgopoulos | 160/178 B |
| 1,038,005 | 9/1912 | Shaft | 160/84 R |
| 1,229,523 | 6/1917 | Roehrich | 160/84 R |
| 2,481,714 | 9/1949 | Bezjian | 160/168 |
| 2,594,806 | 4/1952 | Rosenbaum | 160/173 |
| 3,129,750 | 4/1964 | Brandin | 160/168 |
| 4,202,395 | 5/1980 | Heck | 160/84 R |
| 4,212,341 | 7/1980 | Fisher | 160/84 R |
| 4,473,101 | 9/1984 | Langeler | 160/84 R |

FOREIGN PATENT DOCUMENTS

| | | | |
|---|---|---|---|
| 788452 | 1/1958 | United Kingdom | 160/168 |

*Primary Examiner*—J. Franklin Foss
*Assistant Examiner*—Cherney S. Lieberman
*Attorney, Agent, or Firm*—Pennie & Edmonds

[57] ABSTRACT

A guided cord system for a slatted blind assembly having a plurality of slats interposed between a movable bottom rail and a fixed headrail. The system has at least one lift cord that extends from an end of the bottom rail around a turning point fixed to a frame structure and positioned near the end of the bottom rail opposite the plurality of slats. The lift cord then extends to a guide means associated with the headrail and then back to the bottom rail to which it is connected to form an operating loop. The blind is retracted when the cord moves in one direction and extended when moved in the opposite direction.

5 Claims, 9 Drawing Figures

FIG. 2
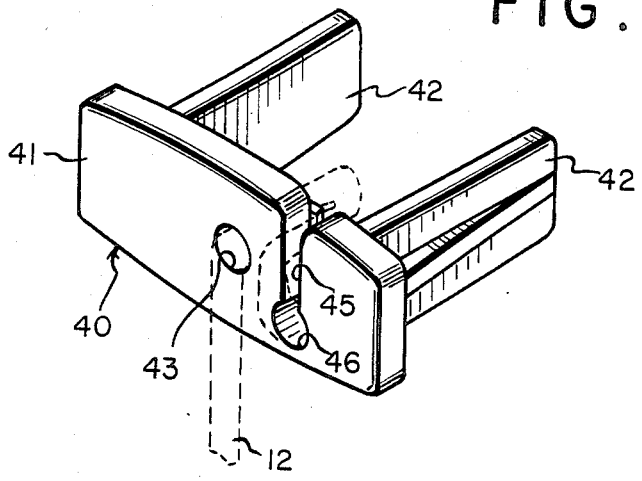
FIG. 3
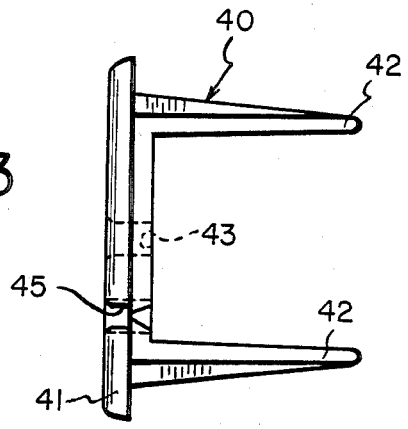
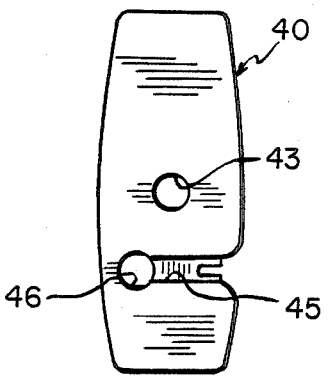
FIG. 4

FIG. 5
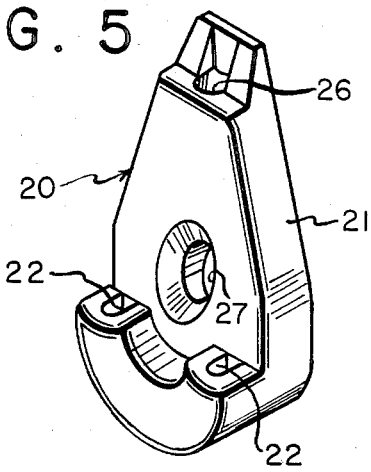
FIG. 6
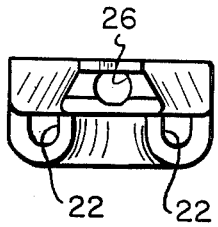
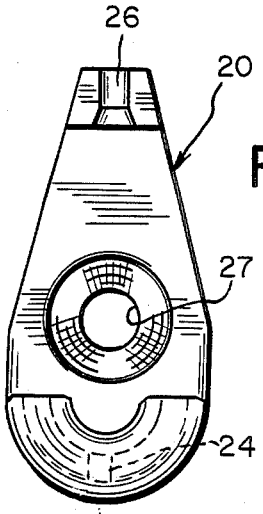
FIG. 7
FIG. 8
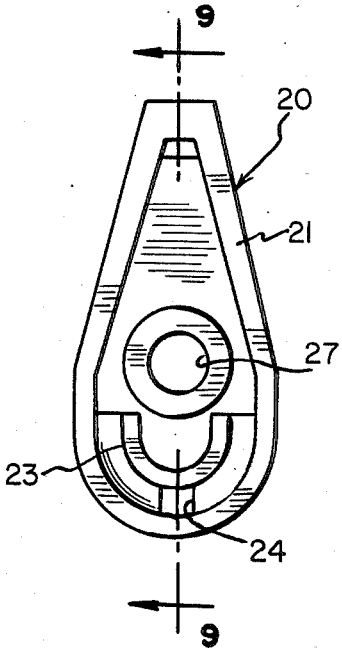
FIG. 9
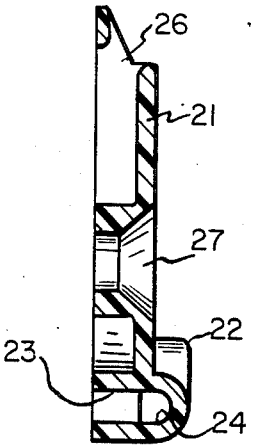

GUIDED CORD SYSTEM FOR A RETRACTABLE SLATTED BLIND ASSEMBLY

FIELD OF THE INVENTION

This invention relates to a guided cord system for a rotatable slatted blind assembly and more particularly to a guided cord system for a venetian blind type of assembly in which it is desired to secure the assembly from rattling due to vibrations or other motions.

BACKGROUND OF THE INVENTION

Blind assemblies used in boats, recreational vehicles or other installations subject to movement often are subject to objectionable rattling caused by the blind assembly banging against the front and/or sides of a window, porthole, skylight or other opening constructions and against glass panes therein. This is because, but for the headrail, the rest of the blind is free to swing due to motion of the structure to which the blind assembly is attached. This can also result in damage to the blind.

In some installations the blind assembly includes a bottom rail which is secured to a frame or in a frame opening and where means supporting the individual slats of the assembly extend between the bottom rail and a headrail which is also secured to the frame or the frame opening. However, even this system will not prevent most of the slats from swinging and banging against the glass pane and frame parts and further the frame opening remains obstructed by the slats even when the slats are tilted to an open horizontal position since the end rail remains fastened to the frame or in the frame opening.

It is therefore an object of my invention to provide for a guided cord system for a slatted blind assembly by which the slats may be retracted to one side of a frame or frame opening, i.e., raising or lifting of the slats in a conventional venetian blind assembly, while at the same time providing a means for preventing the slat assembly from swinging as might be caused by movement of the opening construction to which the slat assembly is mounted.

GENERAL DESCRIPTION OF THE INVENTION

Broadly, a guided cord system constructed according to my invention is for use with a slatted blind assembly having a plurality of slats positioned between an end slat and a fixed support structure. The invention is described herein for convenience for use with a venetian blind assembly, however, it would also be equally applicable for use with blind assemblies having interconnected slat structures including plated blinds whereby slats are formed of textile or plastic strips of material joined together at the folds so as to form an integral part of a sheet material.

Further the blind assembly described herein, and as illustrated in the drawings, is with respect to a conventional venetian blind assembly having a fixed headrail and a movable bottom rail. It is to be understood that the guided cord system of the invention is also applicable for use in inclined, horizontal or vertical blind assemblies and even in upside down vertical assemblies where the bottom rail is fixed to a structure and the opposite upper end slat or rail is movable.

The system of the invention as applied to venetian blinds have a plurality of slats includes a headrail fixable to a structure, a movable bottom rail and at least one pair of lift cords for raising and lowering the blind assembly. Each cord is attached at both its ends to connecting points on the bottom rail. Guide means are associated with each cord of the pair of cords for guiding the cord through the headrail with the cord leaving the headrail near one end. First and second turning means are fixable to a structure below the bottom rail near each end thereof and guide the cords through substantially 180°. Each cord of the pair of cords then extends upwardly from a connecting point on the bottom rail to the guide means associated with the headrail, down to the turning means below the bottom rail and upwardly to a connecting point on the bottom rail.

Preferably each guide means associated with the headrail has a first guide surface to turn a portion of a cord 90° rising from the bottom rail to extend parallel to the slats and a second guide surface to turn the cord 90° from the direction parallel to the slats back towards a turning member. The second guide surface may conveniently be included in end caps mounted at the ends of the headrail.

One point of connection of one cord of the pair of cords is preferably at one end of the bottom rail and one point of connection of the other cord of the pair is at the other end of the bottom rail. The second point of connection of each cord with the bottom rail is between the two points of connection of the other cord with the bottom rail. Preferably all points of connection are along the center line of the bottom rail extending in the longitudinal direction.

The system may preferably include a cable attachment mounted on each end of the bottom rail where the attachment has a cord hole therein which is coaxial with the center line of the bottom rail. The attachment also has a cord securing means through which a cord is threaded in order to secure the cord to the attachment.

The portions of the cords extending between the turning member and the guide means lie substantially in the plane of the slats and near the ends of the slats such that they serve to restrain the slats from longitudinal movement and prevent the slats from banging against the sides of a window opening.

The turning means may comprise a bracket which includes a curved guide on one side of the bracket and a cord passage extending through the member through which a cord passes.

In some instances as with blind assemblies having very heavy or very long slats, it may be desirable to include a further pair or pairs of cords to prevent sagging of the slats. In this event the turning means for each pair of cords at one end of the slats may be combined into a single unit and preferably an integral unit.

An advantage of the blind construction as described is that a blind raising and lowering handle or contact may be applied at any point along the length of the bottom rail. This is because the use of a pair or pairs of lifting cords results in a balanced system such that a lifting or lowering force applied anywhere along the length of the bottom rail will raise or lower the complete blind assembly evenly with respect to the fixed support structure, i.e. the frame of a window opening. That is, the bottom rail will not be tilted because of a force being applied at other than the center of the bottom rail.

DESCRIPTION OF THE DRAWINGS

FIG. 2 is a perspective view of the cord attachment illustrated in FIG. 1 by which an end of a lift cord may be connected to an end of an end rail;

FIG. 3 is a plan view of the attachment of FIG. 2;

FIG. 4 is an end view of the attachment of FIG. 2;

FIG. 5 is a perspective view of the turning point bracket illustrated in FIG. 1;

FIG. 6 is a plan view of the bracket of FIG. 5;

FIG. 7 is a front view of the bracket of FIG. 5;

FIG. 8 is a back view of the bracket of FIG. 5; and,

FIG. 9 is a sectional view of FIG. 8 taken along lines 9—9.

DESCRIPTION OF THE PREFERRED EMBODIMENT

Figure 1:
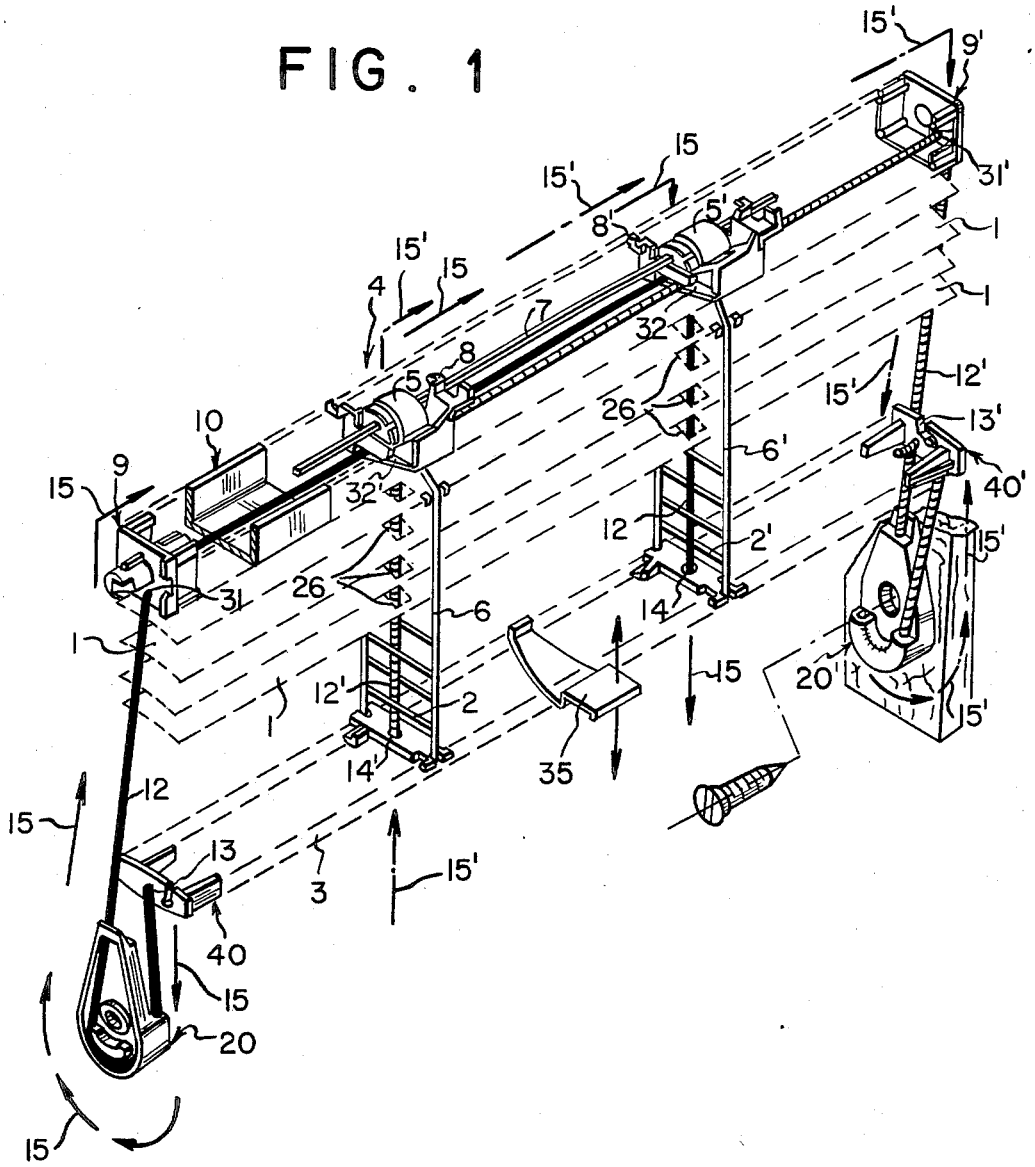
FIG. 1 is a perspective view of a guided cord system for a slatted blind assembly constructed according to the invention.

Referring to FIG. 1 there is as illustrated a slatted blind assembly having a plurality of slats 1 supported by support means 2 and 2', in the form of a tape ladder, extending between a movable bottom rail 3 and a fixed support structure denoted generally 4.

The fixed support structure 4 may comprise conventional tape rolls 5 and 5'over which cables 6 and 6' of the tape ladders extend with the rolls being mounted on a tilt rod 7 rotatably supported by tilt rod supports 8 and 8'. The support structure also includes end caps 9 and 9' positioned in the ends of a headrail 10 and which may serve as a means to mount the headrail to a frame member.

First and second turning members 20 and 20' are fixed to a frame member, now shown, and are positioned on the opposite side of the bottom rail 3 from the slats 1 near their ends.

A fixed guide means is associated with the headrail 10 and comprises a first guide surface 31 contained in the end cap 9 and a second guide surface 32 contained in a tilt rod support 8'. A second fixed guide means is likewise associated with the support structure and comprises a first guide surface 31' defined by the wall surface of a hole contained in end cap 9' and a second guide surface 32' contained in the tilt rod support 8. The first and second guide surfaces of each guide means may comprise rollers or slide surfaces having a low coefficient of friction.

A first lift cord 12 is connected at one of its ends 13 to a cord attachment 40 contained in the end of the bottom rail 3. The cord extends over turning member 20 where it is turned substantially 180° to extend to the first guide means comprising the guide surfaces 31 and 32. From the guide surface 32 the cord 12 extends back to the bottom rail where it is connected at point 14.

As seen by reference to FIG. 1 the cord 12, along with its points of connection 13 and 14, forms a closed operating loop such that movement of the cord 12 in the direction of the arrows 15 over the turning point 20 and fixed guide surfaces 31 and 32 wil cause the bottom rail 3 to move away from the headrail 10 to lower the blind assembly while movement of the cord in an opposite direction will cause the bottom rail 3 to move toward the headrail to retract the blind assembly.

This retracting of the blind assembly is shown by arrows 15' indicating the direction of travel of cord 12' when the bottom rail moves toward the headrail.

The guided cord system includes a second cord 12' connecting a second turning member 10', a second guide means comprising the guide surfaces 31' and 32', and having both of its ends connected to the bottom rail in the same manner as with the cord 12.

As shown the point of connection 14 of the cord 12 with the bottom rail is positioned between the point of connection 14' of the cord 12' with the bottom rail and the attachment 40' while the point of connection 14' of the end of the cord 12' with the bottom rail is positioned between the point of connection 14 and attachment 40. This construction results in a balanced suspension of the bottom rail so that the bottom rail will remain in a horizontal position even though a force is applied to raise or lower the bottom rail by an operating handle 35 at other than the center of the rail.

The point of connection of the ends of each lift cord is along the longitudinal axis of the bottom rail and which is preferably coaxial with the tilt axis of the bottom rail. The lift cords further preferably extend in the plane of the ladder tapes and through route holes 26 contained in the individual slats which further holds the slats in position in both lateral and longitudinal directions with respect to the slats.

Referring to FIGS. 22–4 there is illustrated in further detail the attachment 40 by which an end of a lift cord is secured to an end of the end slat. The attachment includes a body member 41 having two prongs 42 adapted to engage the inner edges of a hollow bottom rail. The body portion includes a cord receiving hole 43 which is adapted to be coaxial with the longitudinal axis of the bottom rail when the attachment is applied to a bottom rail. The body portion also includes a wedgelike slot 45 which serves as a cord securing means and the body portion also includes a further receiving hole 46. As shown in dotted form in FIG. 2 an end of a cord is passed through cord receiving hold 43 and then threaded through the slot 45 where it is secured against further movement. Any excess cord may be pushed through hole 46 into the interior of the bottom rail where it will be out of the way and will not become tangled with other parts of the guided cord system.

Referring to FIG. 5–9 there is illustrated in further detail the turning member 20 which as shown comprises a bracket 21 having a first curved guide surface 22 on one side thereof and a second curved guide surface 23 on an opposite side thereof. A cord passageway 24 extends through the bracket and connects the two curved guide surfaces 22 and 23.

Referring to FIG. 1 it is seen that a cord 12 extends from attachment 40 to the curved guide 22 where it is turned substantially 90°, through the passage 24 and then onto the curved guide surface 23 where it is turned a further 90°, after which it then passes through a guide hole 26 contained at the top of the bracket and on towards the fixed support means 4. A hole 27 is provided in the bracket in order that it may be secured to a frame member, not shown. The provision of having one curved guide on one side of the bracket and the other curved guide on the other side of the bracket assures that the portions of the cord entering and leaving the turning point do not become tangled.

I claim:

1. A guided cord system for a retractable slatted blind assembly comprising a plurality of slats, a headrail adapted to be fixed to a structure, a movable bottomrail, a pair of lift cords for raising and lowering the blind assembly, each cord of said pair being connected at both its ends to said bottomrail, guide means associated with said headrail for guiding each of said cords through said headrail whereby one cord of said pair will leave said headrail near one end thereof and the other cord of said pair will leave said headrail near the other end thereof, a first turning means and a second turning means for guiding the cords substantially 180° with said first turning means adapted to be fixed to a structure below and near one end of the bottomrail and the second turning means adapted to be fixed to a structure below and near the other end of the bottomrail, each cord of said pair extending upwardly from said bottomrail, passing over its guide means, extending downwardly and around its turning means and upwardly to a connecting point on said bottomrail, a first point of connection of one cord of said pair with the bottomrail is at one end of the bottomrail and a first point of connection of the other cord of said pair with the bottomrail is at the other end of the bottomrail and wherein a second point of connection of each cord with the bottomrail is between the two points of connection of the other cord of said pair with the bottomrail, said pair of cords being positioned in and operating in substantially the plane of the blind assembly in the lowered position.

2. A guided cord system according to claim 1 wherein the points of connection of said cords to the bottom rail are along the longitudinal center line of the bottom rail.

3. A guided cord system according to claim 1 wherein the point of connection of each cord of said pair with the end of said bottom rail is through a cable attachment mounted on the end of said bottom rail, said attachment having a cord receiving hole in a side thereof which hole is coaxial with the longitudinal axis of said bottom rail and through which said cord passes, and cord securing means on said attachment through which an end of said cord is threaded to secure the same to said attachment.

4. A guided cord system according to claim 1 having in addition an operating handle mounted on the bottom rail by which the blind assembly may be raised to retract the same and lowered to close the same.

5. A guided cord system for a retractable slatted blind assembly comprising a plurality of slats, a headrail adapted to be fixed to a structure, a movable bottomrail, a pair of lift cords for raising and lowering the blind assembly, each cord of said pair being connected at both its ends to said bottomrail, guide means associated with said headrail for guiding each of said cords through said headrail whereby one cord of said pair will leave said headrail near one end thereof and the other cord of said pair will leave said headrail near the other end thereof, a first turning means and a second turning means for guiding the cords substantially 180° with said first turning means adapted to be fixed to a structure below and near one end of the bottomrail and the second turning means adapted to be fixed to a structure below and near the other end of the bottomrail, said first and second turning means comprising a bracket member having connecting means for connecting the member to a structure, at least one curved guide engaging a cord on at least one side of the bracket member, and a cord passageway extending through said bracket through which a cord passes, each cord of said pair extending upwardly from said bottomrail, passing over its guide means, extending downwardly and around its turning means and upwardly to a connecting point on said bottomrail, said pair of cords being positioned in and operating in substantially the plane of the blind assembly in the lowered position.

* * * * *